United States Patent [19]

Mason

[11] 4,090,314

[45] May 23, 1978

[54] SCRAPER BOWL LIFTING BRACKETS

[75] Inventor: Gary E. Mason, Joliet, Ill.

[73] Assignee: Caterpillar Tractor Co., Peoria, Ill.

[21] Appl. No.: 815,385

[22] Filed: Jul. 13, 1977

[51] Int. Cl.[2] ..... E02F 9/24; B66C 1/10

[52] U.S. Cl. ..... 37/124; 248/499; 105/475; 105/485

[58] Field of Search ..... 37/124, 126 R, 129; 105/473, 475, 476, 481, 485; 248/499, 361

[56] References Cited

U.S. PATENT DOCUMENTS

| | | | |
|---|---|---|---|
| 3,106,377 | 10/1963 | Cotton | 105/485 |
| 3,212,457 | 10/1965 | Looker | 105/473 X |
| 3,371,951 | 3/1968 | Byrant | 105/485 X |
| 3,814,269 | 6/1974 | Blood et al. | 214/145 R |
| 3,888,190 | 6/1975 | Bigge | 105/475 |
| 3,905,633 | 9/1975 | Larson | 105/475 |
| 3,917,213 | 11/1975 | Poehlmann | 105/485 X |

*Primary Examiner*—E. H. Eickholt

*Attorney, Agent, or Firm*—Wegner, Stellman, McCord, Wiles & Wood

[57] ABSTRACT

A lifting and tie-down arrangement is provided for a push frame and scraper bowl assembly and includes a first bracket removably affixed to the outside and/or inside of the draft arm socket in the side walls of the scraper bowl. A second bracket is selectively affixed to the side legs of the push frame whereby lifting equipment connected to the first bracket on the outside of the bowl and to one second bracket on the push frame can be used to safely lift the assembly. Tie-down cables connected to one first bracket on the inside of the bowl and to the other second bracket on the push frame can be used to safely tie the assembly to a flatcar or the like.

8 Claims, 6 Drawing Figures

FIG. 1
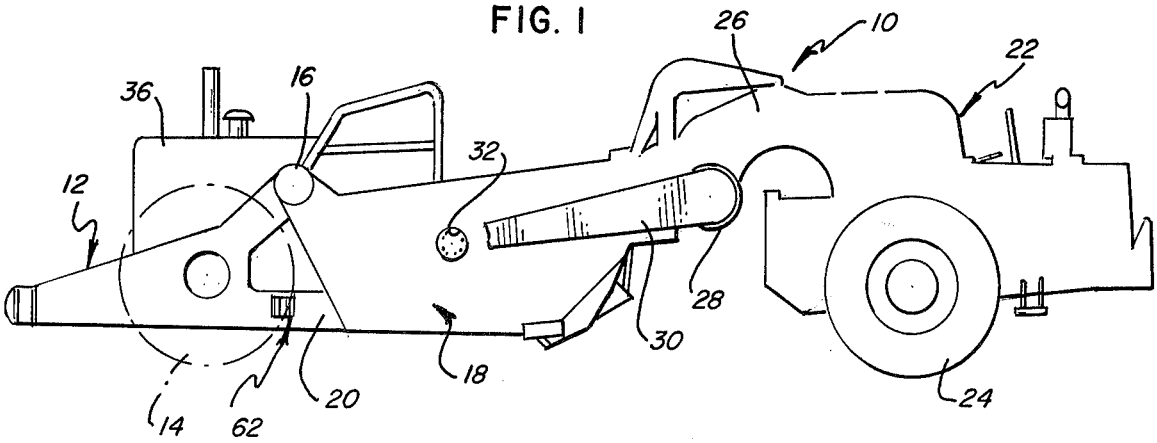
FIG. 2
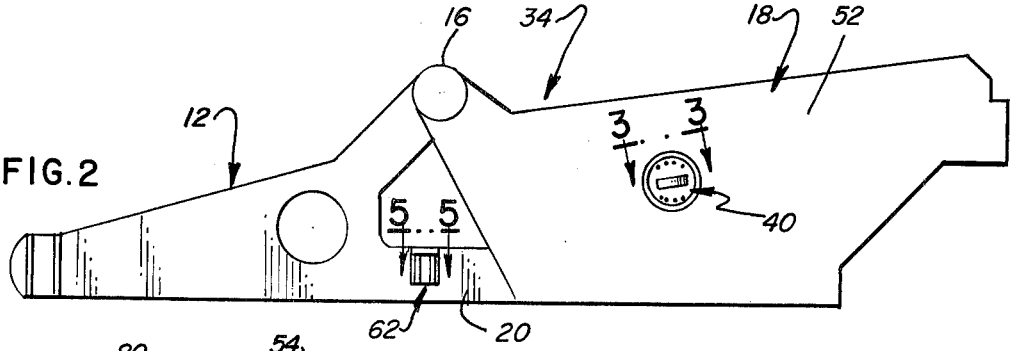
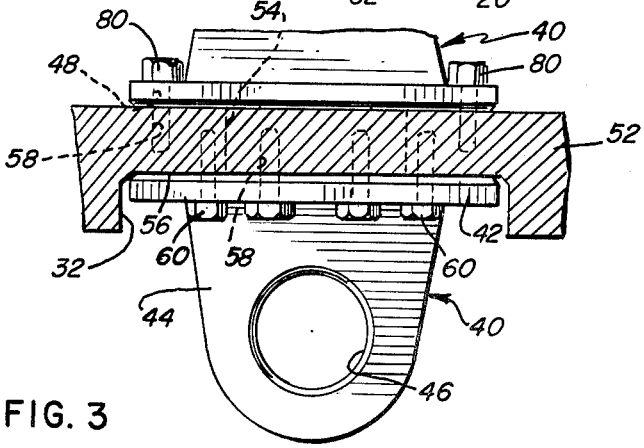
FIG. 3
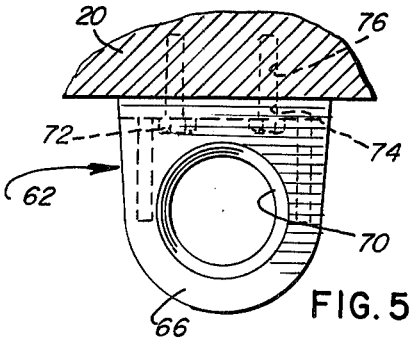
FIG. 5
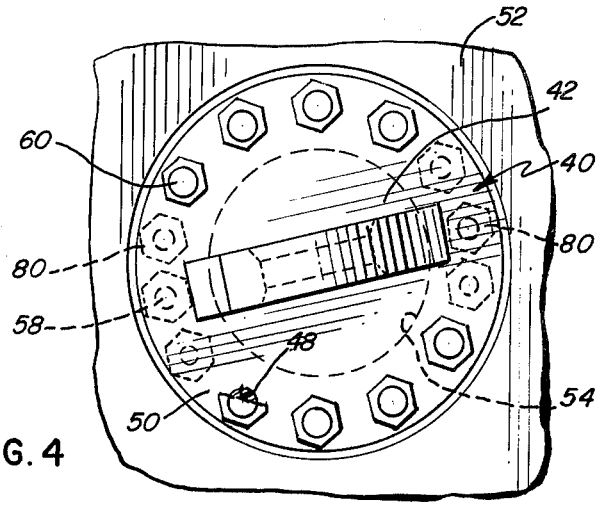
FIG. 4
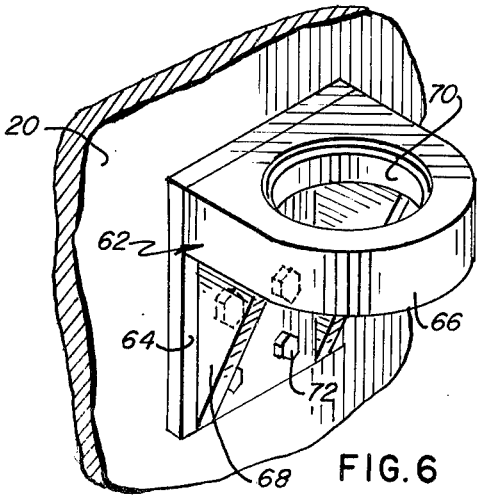
FIG. 6

SCRAPER BOWL LIFTING BRACKETS

BACKGROUND OF THE INVENTION

1. Field of the Invention

This invention relates to a push frame and scraper bowl assembly for a tractor scraper vehicle and, more particularly, to lifting and tie-down brackets for said assembly.

2. Description of the Prior Art

Push frame and scraper bowl assemblies for tractor scrapers have been known and used for many years. Some tractor scrapers are extremely large and are generally used great distances from the manufacturing site. To ship the tractor scraper, it is disassembled, shipped in parts, usually on railroad flatcars, whereupon, at the destination it is reassembled, ready for use.

The push frame and scraper bowl assemblies of some tractor scrapers are so large that they cannot be shipped on their bottoms because they would stick out excessively on either side of the flatcar. Accordingly, they must be lifted and tilted and fastened to the flatcar on their side. The usual procedure in loading the push frame and bowl assembly is to put cables or hooks in or around any convenient part of the assembly. The assembly is then tilted onto its side and lifted and then lowered onto a flatcar. Unfortunately, the procedure of hooking onto the assembly at indiscriminate places has resulted in pulling, distorting, bending, or the like, of parts of the frame and bowl assembly that has caused problems in reassembling the tractor scraper and/or in use of the equipment after reassembly. Heretofore, no provision has been made for affixing temporarily or permanently any brackets for assisting in the loading and unloading of the push frame and bowl assembly.

SUMMARY OF THE INVENTION

The present invention is directed to overcoming one or more of the problems as set forth above.

According to the present invention, lifting brackets are either temporarily and/or permanently affixed at appropriate locations on the push frame and bowl assembly to facilitate tilting and lifting the assembly into position on a flatcar, to act as tie-down brackets during shipment, and to facilitate lifting and righting the assembly from the flatcar into position for reassembly to the remainder of the tractor scraper.

A first bracket is secured to the outside socket on the bowl normally used to attach the rear end of the draft arm to the bowl. With the bracket attached in the socket on the outside of either side of the bowl, one point is established for attaching lifting equipment to the bowl without doing damage or harm to the bowl. A second bracket is secured at an appropriate location on one side wall of the push frame. The second bracket is located so as to properly distribute the load of the push frame and bowl assembly for lifting and tilting said assembly onto its side. For tie-down purposes, a bracket, like the first-named bracket, is secured to the inside of the same socket used for the first-named bracket, which bracket can be used as one point for tying the assembly to the flatcar. Another bracket like the second bracket is attached to the side of the push frame opposite to where the first-mentioned second bracket is attached, said another bracket is used as a second point for tie-down purposes.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is an elevational view of a tractor scraper containing a push frame and bowl assembly;

FIG. 2 is an enlarged, elevational view of the push frame and bowl assembly separated from the tractor scraper of FIG. 1;

FIG. 3 is an enlarged, cross-sectional view of a bowl bracket taken along the lines 3—3 of FIG. 2;

FIG. 4 is a plan view of the bowl bracket of FIG. 3;

FIG. 5 is an enlarged, cross-sectional view of a push-frame bracket taken along the lines 5—5 of FIG. 2; and FIG. 6 is a plan view of the push-frame bracket of FIG. 5.

DESCRIPTION OF THE PREFERRED EMBODIMENT

Referring to the drawings, and in particular to FIG. 1, a tractor scraper 10 includes a push frame 12 carried by a pair of rear wheels 14. A spreader tube 16 extends between the push frame 12 and a bowl 18, with the bowl 18 being additionally secured to the push frame 12 on the forward end of the pair of side legs 20 of the push frame. The scraper 10 is pulled by a tractor 22 mounted on wheels 24. The tractor 22 is connected to the bowl 18 by means of a conventional hitch and goose-neck arrangement 26 connected to a transverse spreader 28, which spreader 28 has draft arms 30 extending from opposite ends thereof and which draft arms are connected into sockets 32 substantially at the midportion of the sides of the bowl 18. The push frame 12 and bowl 18 are rigidly secured together in a push frame and scraper bowl assembly 34. A separate engine and transmission 36 is carried by the push frame 12 which is used to assist in propelling the scraper 10 over the ground and in loading and unloading the bowl 18. All of the structure described hereinabove is fairly conventional, currently available, tractor scraper apparatus.

An improved arrangement for lifting and tilting the push frame and scraper bowl assembly 34 has been devised which includes locating and securing lifting brackets to the push frame 12 and scraper bowl 18 at appropriate points so as to facilitate connecting, lifting and/or tie-down equipment to said brackets for safely tilting, lifting and/or tying down said assembly 34.

Specifically, referring to FIGS. 2 through 4, a bowl bracket 40 is provided and includes a circular mounting plate 42 which has attached thereto, as by welding or the like, a transversely extending member 44 having an opening or eye 46 passing therethrough. A plurality of equally spaced openings 48 are formed around the outer peripheral portion 50 of the plate 42 for a purpose to be described hereinafter.

The scraper bowl 18 has the sockets 32 formed in the midportion of the outer side walls 52 thereof, which sockets 32 are recessed with respect to said side walls. The center portion of the socket 32 has an opening 54 therethrough, through which, normally, the pivots connecting the draft arm 30 to the bowl 18 pass. The peripheral portion 56 of the socket 32 has a plurality of equally spaced apart, tapped holes 58 formed therein with the spacing between the tapped holes 58 corresponding with the spacing between the openings 48 formed around the outer peripheral portion 50 of the plate 42 of the bowl bracket 40. The bowl bracket 40 is positioned in the socket 32 and a plurality of bolts 60 are passed through the openings 48 in the peripheral portion 50 of the plate 42, which bolts 60 are threaded into the tapped holes 58 formed around the peripheral portion 56 of the socket 32 in the bowl 18. As illustrated, eight bolts 60 are used with each bolt being drawn up tight so as to securely attach the bowl bracket 40 to the outside wall 52 of the bowl 18. The eight bolts are clustered into two groups of four leaving two diametrically spaced arcs of three unused tapped holes 58 therebetween.

In practice, the bowl bracket 40 is attached to the side of the bowl 18 intended to be facing upward during shipment so as to provide one point of attachment of the lifting equipment. Assuming that the assembly 34 is on one side, the center of gravity of the assembly is to the left of the bowl bracket 40, as viewed in FIG. 2. With a cable connected in the opening 46 of the bowl bracket 40, a point to the left of the center of gravity is found which will substantially, evenly distribute the lifting load of the assembly 34 between said point and the bowl bracket 40. A push-frame bracket 62 is secured as by bolting to the leg 20 of the push frame 12.

The push-frame brackets 62 include a square or rectangular base plate 64 to which an eye member 66 is attached and extends transversely thereto. The eye member is either welded to the plate 64 or integrally formed therewith. Braces or gussets 68 extend between and are attached to the plate 64 and the eye member 66 so as to provide additional support. The eye member 66 has an opening or eye 70 formed therethrough, through which cables, hooks, or the like, are passed for attaching lifting equipment to the assembly 34. A plurality of openings 74 are formed through the plate 64, which openings 74 are aligned with tapped holes 76 formed in the walls of the side legs 20 of the push frame 12. The push-frame bracket 62 has bolts 72 passed through opening 74 in the plate 64 and threaded into tapped holes 76 formed in the side walls of the legs 20 for securing the push-frame bracket 62 to the side leg 20 of the push frame 12. A push-frame bracket 62 can be attached to the leg 20 on each side of the push frame 12. It should be understood that the push-frame brackets 62 can be removed after each completed shipment of the assembly 34.

In practice, the bowl bracket 40 is bolted in the socket 32 on the outside of one wall 52 of the bowl 18 using eight bolts 60. Thereafter, lifting cables, not shown, are connected in the opening 46 of bracket 40 and in the eye 70 of the push-frame bracket 62 and the assembly 34 raised in a balanced, substantially level, altitude. Only one bowl bracket 40 and one push-frame bracket 62 are needed for a lifting operation of the type described. The bowl bracket 40 can be removed to reduce the height of the assembly above the flatcar. The push-frame bracket 62 can be left on or can be removed from the leg 20 since the bracket 62 does not extend beyond the confines of the assembly.

To secure the assembly 34 to a flatcar or the like, a bowl bracket 40 can be bolted to the inside of the bowl 18 by passing bolts 80 through the openings 48 in the bracket 40 and threading said bolts 80 into the tapped holes 58 from the inside of the bowl. The bolts 80 are threaded into the six holes 58 between the eight holes 58 used by the bolts 60 for the outside bowl bracket 40, in this way, two bowl brackets 40 can be attached to the same socket 32, one on the inside and one on the outside of the bowl 18. Cables can be run from the flatcar to the bracket 40 on the inside of the bowl 18 for partially securing the assembly 34 to the flatcar.

A second cable can be connected between the push-frame bracket 62 on the downwardly facing side of the leg 20 and the flatcar to provide additional tie down for the assembly.

From the above, it can be seen that I have provided an improved push frame and scraper bowl assembly lifting arrangement whereby appropriate brackets 40,62 are secured to the push frame and bowl assembly 34 at predetermined locations of relatively high structural integrity so that the assembly can be lifted using said brackets without distorting or otherwise damaging the assembly 34. In addition, one bowl bracket 40 can be attached to the inside of the bowl to be used as a tie-down bracket, while the downwardly facing push-frame bracket 62 can be used as an additional tie-down bracket.

The embodiment of the invention in which an exclusive property or privilege is claimed is defined as follows:

1. In a lifting arrangement for a push frame and scraper bowl assembly, the push frame of said assembly having forwardly extending side legs connected to the lower portion of the scraper bowl, and the scraper bowl of said assembly having side walls and a socket located substantially in the midportion of each side wall normally used to mount other scraper bowl components when assembled in an operative condition, said socket having equally spaced, tapped holes around the outer periphery thereof, in combination, first bracket means secured in one of said sockets in said bowl in the absence of said other bowl components, and second bracket means secured to one of said side legs of said push frame whereby lifting equipment connected to said first and second bracket means can be used to lift said push frame and scraper bowl assembly in a balanced, substantially level, altitude and alternatively serving as tie-down engagements during transport of the assembly.

2. In a lifting arrangement as claimed in claim 1 wherein said first bracket means comprises a plate having a plurality of equally spaced apart openings formed about the outer peripheral portion thereof, said openings in said plate being positioned to align with a predetermined number less than the total number of the tapped holes in said socket, a member secured to said plate, an eye formed in said member and a plurality of bolts passing through said openings in the plate and being threaded into said tapped holes for securing said first bracket means to the side wall of said bowl.

3. In a lifting arrangement as claimed in claim 1 wherein said second bracket means comprises a plate having a plurality of openings formed therethrough, a member secured to said plate, an eye formed through said member, and a plurality of bolts passing through said plate and being threaded into tapped holes in the side legs of said push frame for securing said second bracket means to the side legs of said push frame.

4. In a lifting arrangement as claimed in claim 1 wherein a third bracket means is secured in said socket on the inside of said bowl, said third bracket means comprising a circular plate and a member having an eyelet secured to said plate, and bolts passing through said plate into a predetermined number of remaining tapped holes not being utilized by said first bracket means in said socket for securing said third bracket means to the inside of said bowl whereby tie-down cables can be affixed thereto for partially tying said assembly to a flatcar.

5. A push frame and scraper bowl assembly having a push frame, a scraper bowl fastened to said push frame and having a socket located in the midportion of each side wall of said bowl, a lifting bracket secured in one of said sockets, said lifting bracket including a plate, a member having an eyelet extending perpendicular to and being secured to said plate, a plurality of bolts passing through said plate and into holes around the periphery of said socket for securing said bracket to said bowl.

6. A push frame and scraper bowl assembly as claimed in claim 5 wherein said lifting bracket is bolted on the outside of said bowl.

7. A push frame and scraper bowl assembly as claimed in claim 5 wherein one of said lifting brackets is secured in the outside of each of said sockets.

8. A push frame and scraper bowl assembly as claimed in claim 5 wherein one of said lifting brackets is bolted on the inside of one of said sockets.

* * * * *